US010939209B2

(12) United States Patent
Chen

(10) Patent No.: US 10,939,209 B2
(45) Date of Patent: Mar. 2, 2021

(54) SPEAKER

(71) Applicant: Eastech (Huiyang) Co., Ltd., Guangdong (CN)

(72) Inventor: Cheng Chen, Guangdong (CN)

(73) Assignee: Eastech (Huiyang) Co., Ltd., Guangdong (CN)

( * ) Notice: Subject to any disclaimer, the term of this patent is extended or adjusted under 35 U.S.C. 154(b) by 0 days.

(21) Appl. No.: 16/667,892

(22) Filed: Oct. 29, 2019

(65) Prior Publication Data

US 2020/0382873 A1 Dec. 3, 2020

(30) Foreign Application Priority Data

May 31, 2019 (CN) ..... 201910468916.2

(51) Int. Cl.

| | |
|---|---|
| ***H04R 7/26*** | (2006.01) |
| ***H04R 7/12*** | (2006.01) |
| ***H04R 9/02*** | (2006.01) |
| ***H04R 9/06*** | (2006.01) |
| ***H04R 7/18*** | (2006.01) |

(52) U.S. Cl.

CPC ..... *H04R 7/26* (2013.01); *H04R 7/127* (2013.01); *H04R 7/18* (2013.01); *H04R 9/025* (2013.01); *H04R 9/06* (2013.01); *H04R 2400/11* (2013.01)

(58) Field of Classification Search

CPC . H04R 7/26; H04R 7/18; H04R 7/127; H04R 2400/11

See application file for complete search history.

(56) References Cited

U.S. PATENT DOCUMENTS 8,295,538 B2 * 10/2012 Harris ..... H04R 9/043 381/404
2011/0268310 A1 * 11/2011 Bullimore ..... H04R 31/006 381/398

* cited by examiner

*Primary Examiner* — Sunita Joshi
(74) *Attorney, Agent, or Firm* — CKC & Partners Co., LLC

(57) ABSTRACT

A speaker includes a basket and a diaphragm assembly. The diaphragm assembly is located on the basket, and has a diaphragm, a damper, a surround, and a conductor. An inner edge and an outer edge of the damper are respectively connected to a bottom surface of the diaphragm and the basket. The surround and the damper are disposed on the basket and at different horizontal levels. The conductor is located on a bottom surface of the damper. The diaphragm assembly can be pre-manufactured to improve the convenience of assembling the speaker. Moreover, the damper does not move up and down exceedingly along with the voice coil, thereby preventing the damper from contacting underlying components. In addition, the total thickness of the speaker can be reduced, which facilitates thinning requirements. Alternatively, an excursion length can be increased, which facilitates the low frequency design of the speaker.

9 Claims, 13 Drawing Sheets

SPEAKER

RELATED APPLICATIONS

This application claims priority to China Application Serial Number 201910468916.2, filed May 31, 2019, which is herein incorporated by reference.

BACKGROUND

Field of Invention

The present invention relates to a speaker, especially relates to a thin speaker.

Description of Related Art

A speaker is an important component with respect to sound effect. Audio-frequency power can enable a diaphragm (e.g., a paper cone or a film) of the speaker to vibrate and resonate with the surrounding air to form a sound through electromagnetic, piezoelectric, or electrostatic effects. There are many types of speakers. According to the switching mechanism and structure, speakers can be sorted of dynamic type (electric type), condenser type (electrostatic type), piezo type (crystal or ceramic), electromagnetic type (compressed spring type), electric ion type and pneumatic type, etc. Electric speaker has the advantages of good electroacoustic performance, firm structure, low cost, etc., and is extensively used.

Generally speaking, a damper (or cushion) of a speaker is located between a voice coil and a basket. For example, the inner edge of the damper is adhered to the voice coil. Under an action of electroacoustic principle, when the output voltage of the speaker is large (i.e., the power is required to be increased), the voice coil with the damper would generate a large up motion and a large down motion, such that the damper is in contact with other underlying components. In order to solve the contacting problem mentioned above, although moving the diaphragm in an upward direction and increasing a height of the voice coil may overcome problem, the total thickness of the speaker would be significantly increased and results in an inconvenient factor for thinning requirements.

SUMMARY

An aspect of the present invention is to provide a speaker.

According to an embodiment of the present invention, a speaker includes a basket and a diaphragm assembly. The diaphragm assembly is located on the basket, and has a diaphragm, a damper, a surround, and a conductor. An inner edge and an outer edge of the damper are respectively connected to a bottom surface of the diaphragm and the basket. The surround and the damper are disposed on the basket and at different horizontal levels. The conductor is located on a bottom surface of the damper.

In one embodiment of the present invention, the surround and the damper are disposed on a first connection position of the basket and at different horizontal levels.

In one embodiment of the present invention, the surround and the damper are respectively disposed on a first connection position and a second connection position of the basket, and are at different horizontal levels.

In one embodiment of the present invention, a lengthwise direction of the conductor is the same as a radial direction of the damper, the conductor and the bottom of the damper are wave-shaped, and the conductor is conformally on the bottom surface of the damper.

In one embodiment of the present invention, the damper includes a voice coil. The voice coil is surrounded by the basket and has a conductive wire, the conductive wire is electrically connected to an end of the conductor proximal to the voice coil, and an end of the conductor facing away from the voice coil passes through the basket.

In one embodiment of the present invention, an inner edge of the surround is connected to an upper side or a lower side of an outer edge of the diaphragm.

In one embodiment of the present invention, the speaker further includes a voice coil. A top portion of the voice coil is connected to the bottom surface of the diaphragm, and the voice coil is covered by a central region of the diaphragm.

In one embodiment of the present invention, the top portion of the voice coil is connected to the bottom surface of the diaphragm by the damper.

In one embodiment of the present invention, the diaphragm and the damper are gradually lowered from the voice coil to an outer edge of the basket.

In one embodiment of the present invention, the speaker further includes a supporting ring located between an outer edge of the surround and the basket.

In the aforementioned embodiments of the present invention, because the inner edge of the surround of the speaker is connected to the bottom surface of the damper and the surround and the damper are disposed on the basket at different horizontal levels and the conductor is located on the bottom surface of the damper, the diaphragm assembly can be pre-manufactured to improve the convenience of assembling the speaker. Moreover, when the speaker is in operation, the damper not connected to the voice coil does not move up and down exceedingly along with the voice coil, thereby preventing the damper from being in contact with underlying components and affecting acoustic performance. In addition, since the voice coil does not need to reserve a position for connecting the damper, the total thickness of the speaker can be reduced, which facilitates thinning requirements. Alternatively, the total thickness of the speaker can be maintained but an excursion length can be increased, which facilitates the low frequency design of the speaker.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
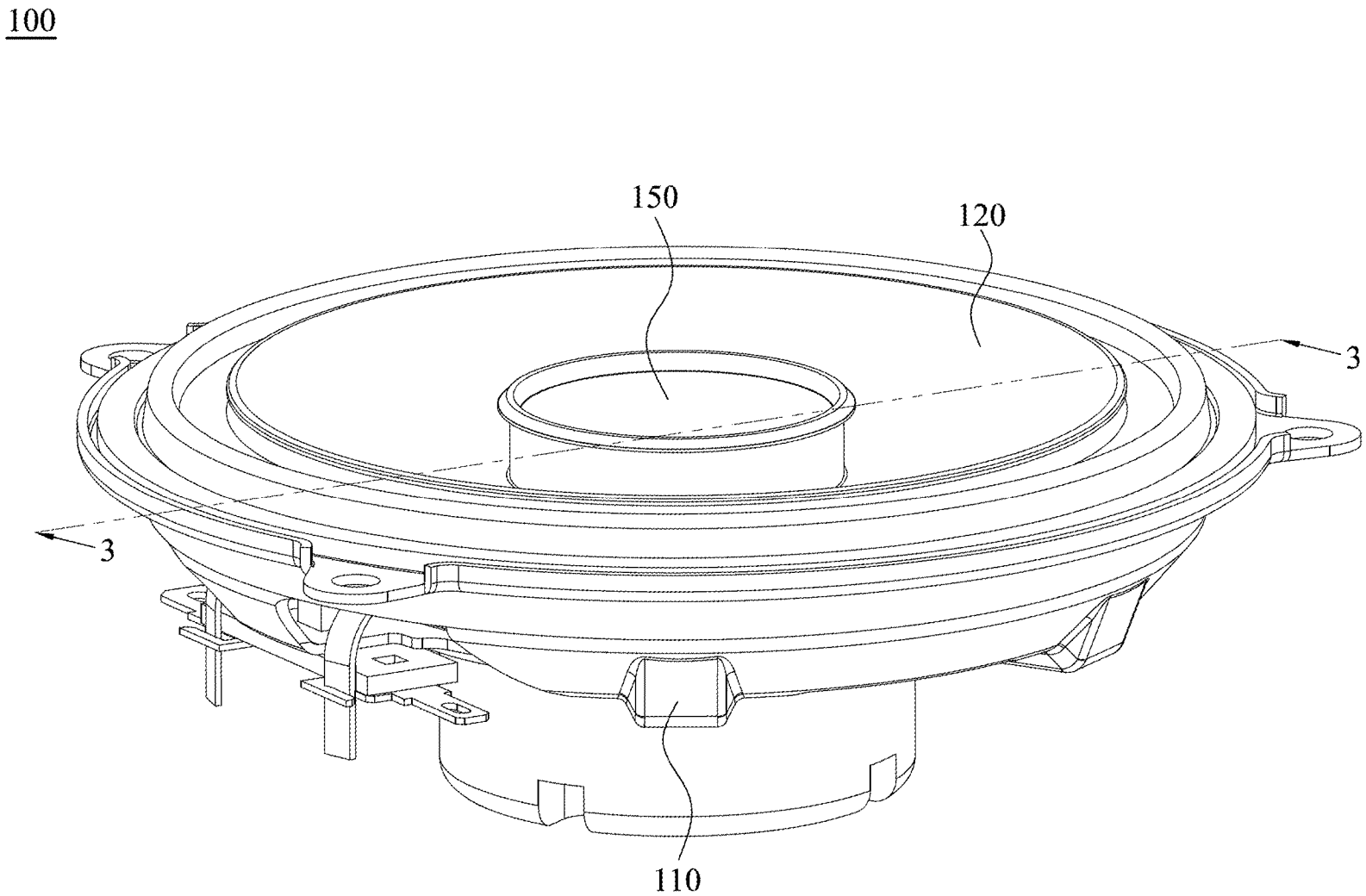
FIG. 1 is an enlarged view of a speaker according to one embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
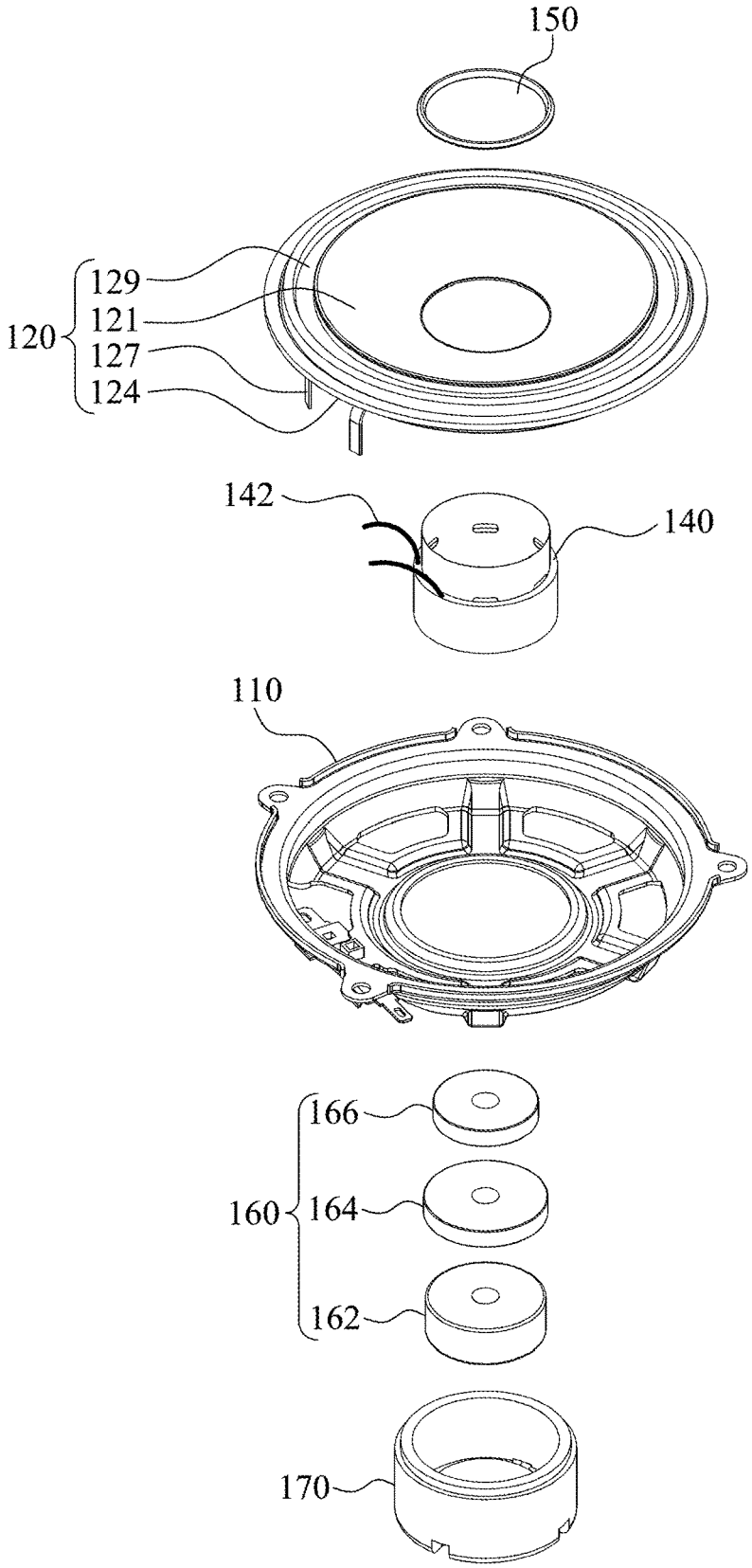
FIG. 2 is an exploded view of the speaker of FIG. 1.

FIG. 1 is perspective view of a speaker 100 according to one embodiment of the present invention. FIG. 2 is an exploded view of the speaker 100 of FIG. 1. As shown in FIG. 1 and FIG. 2, the speaker includes a basket 110, a diaphragm assembly 120, a voice coil 140, a dustproof cap 150, a magnetic assembly 160, and a U-shaped iron 170. The diaphragm assembly 120 is located on the basket 110 capable of supporting. The U-shaped iron 170 and the voice coil 140 are assembled to a bottom portion of the basket 110. In this embodiment, the U-shaped iron 170 can accommodate the voice coil 140 and the magnetic assembly 160, and the voice coil 140 is located between the U-shaped iron 170 and the magnetic assembly 160. The magnetic assembly 160 may include a first magnet 162, a washer 164 and a second magnet 166 that are stacked in sequence, but the present invention is not limited in this regard.

The voice coil 140 is a driving unit of the speaker 100. Generally, very thin copper wires 142 in two layers are wound around a tube (i.e., a coil), which surrounds the magnetic assembly 160. When a sound signal and a current varies with time are passed into the voice coil 140, magnetic fields in different directions are generated in one moment and the next moment. The voice coil 140 vibrates up and down based on a variation of a magnetic force, and the diaphragm 121 are moved back and forth by the voice coil 140, such that the speaker 100 makes sound.

In this embodiment, the diaphragm assembly 120 includes a diaphragm 121, a damper 124, and a conductor 127. The diaphragm 121 may be referred to as a vibrating diaphragm or a drum paper, and the damper 124 may be referred to as a cushion or a spider. The damper 124 is adhered to the diaphragm 121. In order to improve the convenience of assembling the speaker 100, the diaphragm assembly 120 can be pre-manufactured before assembling the speaker 100. The diaphragm 121 may be made of a material that is lightweight and has good rigidity to avoid changing along with changes in ambient temperature and humidity. For example, the material of the diaphragm 121 may be natural fiber, rayon, resin, rubber or metal. Natural fiber may be selected from cotton, wood, wool, silk, etc., and rayon may be selected from artificial silk, nylon, glass fiber, etc., but the present invention is not limited in this regard.

In the following description, inner structures of the speaker 100 after being assembled will be explained.

Figure 3:
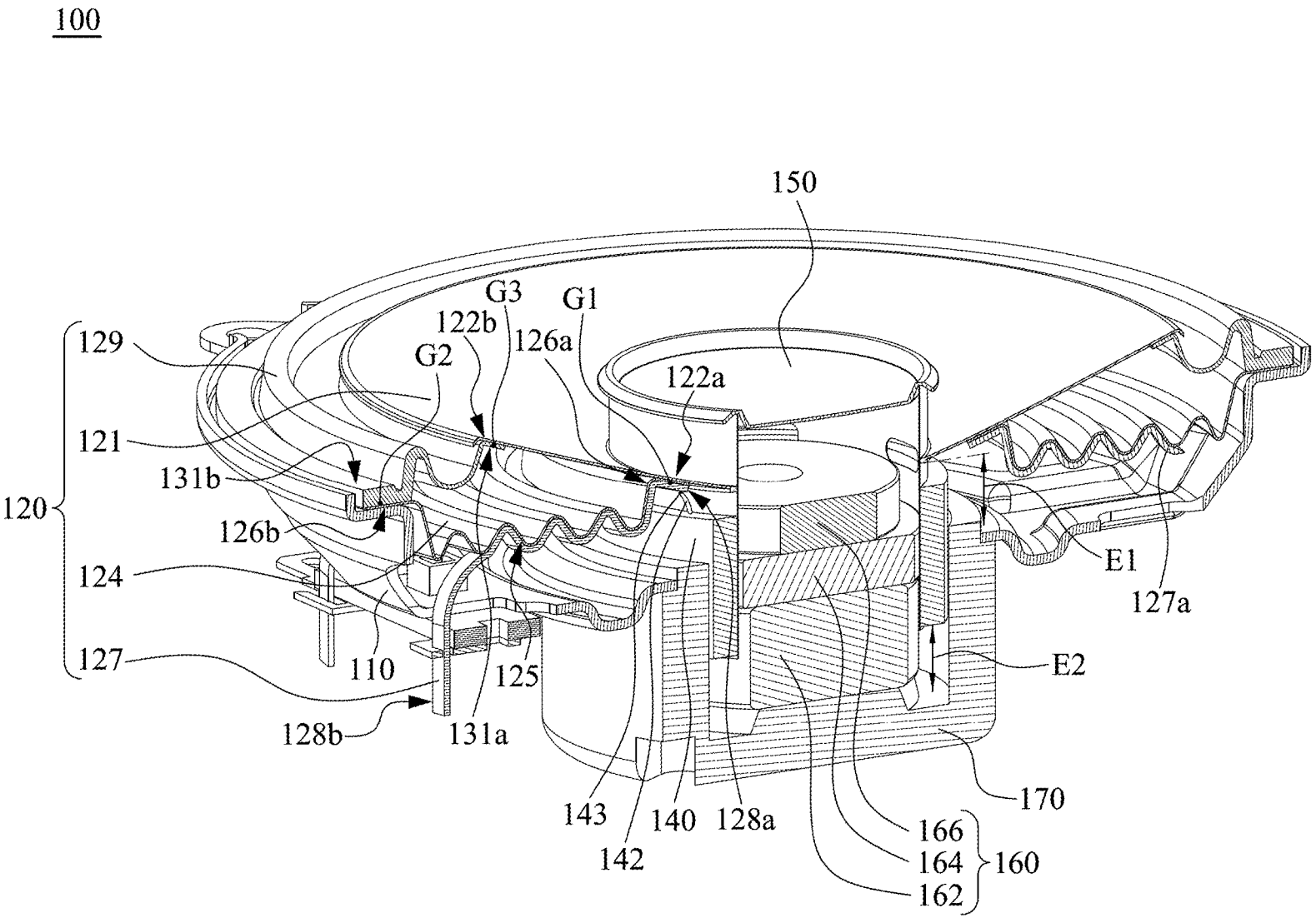
FIG. 3 is a cross-sectional view of a speaker taken along line 3-3 shown in FIG. 1.

FIG. 3 is a cross-sectional view of the speaker 100 taken along line 3-3 shown in FIG. 1. As shown in FIG. 2 and FIG. 3, the diaphragm 121 and the damper 124 are both annular. The material of the damper 124 may be, but not limited to cloth. The diaphragm 121 has an inner edge 122*a* and an outer edge 122*b* opposite the inner edge 122*a*, and the damper 124 also has an inner edges 126*a* and an outer edges 126*b* opposite the inner edges 126*a*. The inner edge 122*a* of the diaphragm 121 can be fixed to the voice coil 140. The inner edge 126*a* and the outer edge 126*b* of the damper 121 are respectively connected to the bottom surface of the diaphragm 121 and the basket 110.

In addition, the speaker 100 may include a first adhesive G1. The first adhesive G1 can adhere the inner edge 126*a* of the damper 124 to the bottom surface of the diaphragm 121. In this embodiment, the inner edge 126*a* of the damper 124 is adhered to a position of the bottom surface of the diaphragm 121 proximal to the inner edge 122*a*, but the present invention is not limited in this regard. For example, the inner edge 126*a* of the damper 124 can be adhered to any position between the inner edge 122*a* and the outer edge 122*b* of the diaphragm 121 as deemed necessary by design.

Since the voice coil 140 is separated from the damper 124, when the speaker 100 is in operation, the damper 124 not connected to the voice coil 140 does not move up and down (front and rear) exceedingly along with the voice coil 140, which can prevent the damper 124 from being in contact with the underlying components (e.g., the U-shaped iron 170, the magnetic assembly 160, or the bottom portion of the basket 110) and affecting acoustic performance and lifespan.

Further, an excursion length E1 is a distance between the inner edge 122*a* of the diaphragm 121 and the top portion of the U-shaped iron 170, and an excursion length E2 is a distance between the bottom portion of the voice coil 140 and the bottom portion of the U-shaped iron 170. Because the voice coil 140 does not need to reserve a position for connecting the damper 124, a height of the voice coil 140 can be reduced and the total thickness of the speaker 100 can be reduced, which facilitates thinning requirements. Alternatively, the total thickness of the speaker 100 can be maintained but the excursion lengths E1 and E2 can be increased, which facilitates the low frequency design of the speaker 100.

Figure 4:
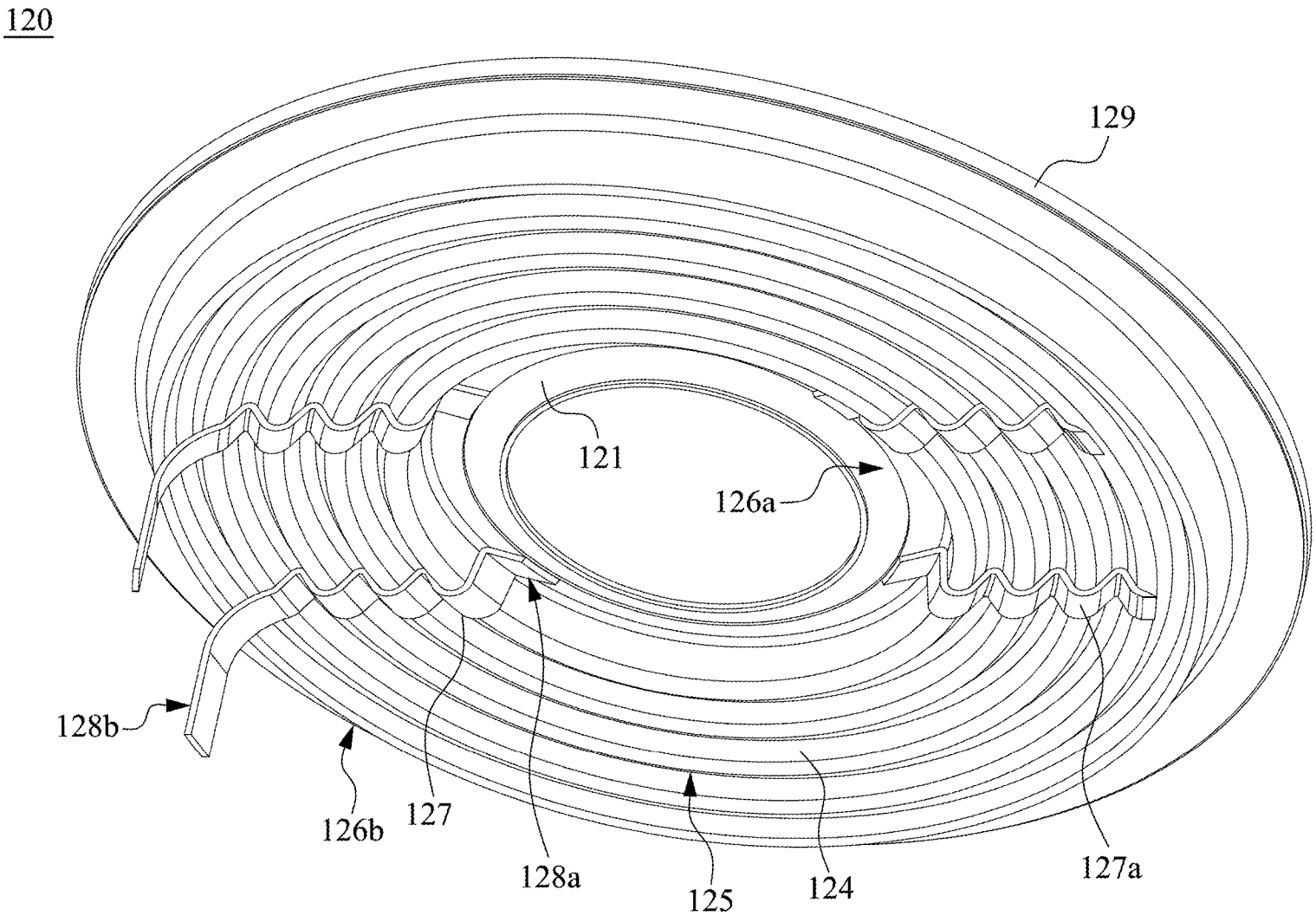
FIG. 4 is a perspective view of the diaphragm assembly of FIG. 2 when viewed from below.

FIG. 4 is a perspective view of the diaphragm assembly 120 of FIG. 2 when viewed from below. As shown in FIG. 3 and FIG. 4, the conductor 127 is located on the bottom surface 125 of the damper 124. The conductor 127 may be an elongated metal strip. In this embodiment, the conductor 127 may be sewn on the bottom surface 125 of the damper 124 such that the conductor 127 can directly contact with the damper 124. A lengthwise direction of the conductor 127 in contact with the damper 124 is the same as a radial direction of the damper 124. The conductor 127 and the bottom surface 125 of the damper 124 may be both wave-shaped, and thus the conductor 127 is conformally on the bottom surface 125 of the damper 124 to achieve a close arrangement, thereby reducing wasting space.

In this embodiment, the conductor 127 has two opposite ends 128*a* and 128*b*. The end 128*a* of the conductor 127 is proximal to the voice coil 140, and the other end 128*b* of the conductor 127 is distal to the voice coil 140 and passes through the basket 110. The end 128*b* of the conductor 127 can be electrically connected to an external power. In addition, the voice coil 140 is surrounded by the basket 110 and electrically connected to the end 128*a* of the conductor 127. For example, the voice coil 140 has a conductive wire 142, and the conductive wire 142 is electrically connected to the end 128*a* of the conductor 127 proximal to the voice coil 140. The wire 142 of the voice coil 140 may be fixed on the end 128*a* of the conductor 127 by soldering to form a solder point 143.

Since the inner edge 126*a* of the damper 124 of the speaker 100 is adhered to the bottom surface of the diaphragm 121 by the first adhesive G1 and the conductor 127 is located on the bottom surface 125 of the damper 124, the diaphragm assembly 120 may be pre-manufactured to improve the convenience of assembling the speaker 100 of FIG. 1.

In this embodiment, the diaphragm assembly 120 may further include a conductor 127*a* that is substantially symmetrical with the conductor 127. The conductor 127*a* is disposed to balance the weight of the diaphragm 120 rather than the use of electrical conduction. The shape, weight and material of the conductor 127*a* may be substantially the same as the conductor 127, but the conductor 127*a* does not have an end like the end 128*b* of the conductor 127 that extends downward.

In this embodiment, the diaphragm assembly 120 includes the surround 129. The surround 129 and the damper 124 are disposed on a first connection position of the basket 110 and at different horizontal levels. A portion of the damper 124 adjacent to the outer edge 126*b* is covered by the surround 129. In other words, the outer edge 126*b* of the damper 124 overlaps an outer edge 131*b* of the surround 129. An inner edge 131*a* of the surround 129 is connected to the outer edge 122*b* of the diaphragm 121, and the inner edge 131*a* of the surround 129 is located on a lower side of the outer edge 122*b* of the diaphragm 121. However, in alternative embodiment, the inner edge 131*a* of the surround 129 may be located on an upper side of the outer edge 122*b* of the diaphragm 121 as deemed necessary by design. The outer edge 131*b* of the surround 129 is connected to the outer edge 126*b* of the damper 124. The diaphragm assembly 120 further includes a second adhesive G2. The second adhesive G2 can adhere the outer edge 126*b* of the damper 124 to the outer edge 131*b* of the surround 129. In addition, the diaphragm assembly 120 may further include a third adhesive G3. The third adhesive G3 can adhere the inner edge 131*a* of the surround 129 to the outer edge 122*b* of the diaphragm 121. In other embodiments, the surround 129 may be connected to the outer edge 122*b* of the diaphragm 121 by hot pressing. After the diaphragm assembly 120 is assembled, the outer edge 131*b* of the surround 129 and the outer edge 126*b* of the damper 124 can be disposed on the basket 110.

The surround 129 is an annular structure, and its cross-sectional shape may be an annular shape, a concave shape, a convex shape, a wavy shape, a triangle shape, a square shape, a polygonal shape, or combinations thereof, which may be determined as deemed necessary by the design of the speaker 100. In this embodiment, the surround 129 has a wavy shape shown in FIG. 3. The surround 129 may be made of a material including rubber, foam, or cloth, but the present invention is not limited in this regard. When the voice coil 140 and the diaphragm 121 are in operation, the surround 129 and the damper 124 can prevent the voice coil 140 and the diaphragm 121 from horizontal (e.g., in left and right directions) shaking, and can provide damping to the voice coil 140 and the diaphragm 121 to have certain restoring force.

It is to be noted that the connection relationships, materials, and advantages of the elements described above will not be repeated. In the following description, other types of surrounds, dampers, and diaphragms will be described.

Figure 5A:
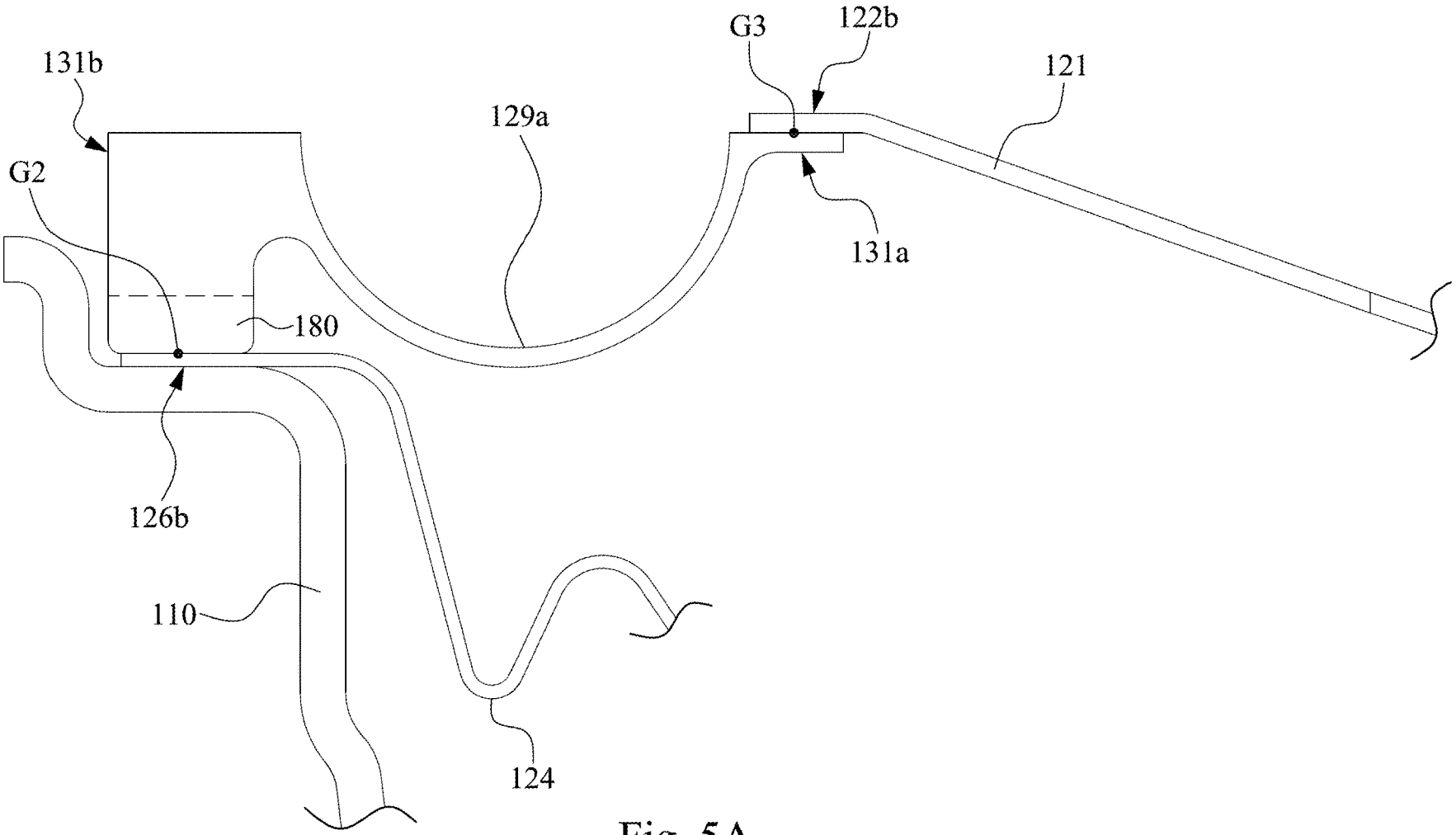
FIG. 5A is a cross-sectional view of a surround according to another embodiment of the present invention.

FIG. 5A is a cross-sectional view of a surround 129*a* according to another embodiment of the present invention. The difference between this embodiment and the embodiment of FIG. 3 is that the cross-sectional shape of the surround 129*a* of FIG. 5A is concave. In the embodiment, the inner edge 131*a* of the surround 129*a* is on the lower side of the outer edge 122*b* of the diaphragm 121. However, in other embodiments, the inner edge 131*a* of the surround 129*a* may be on the upper side of the outer edge 122*b* of the diaphragm 121, depending on actual demand. In the embodiment, the material of the surround 129*a* may be an integrally formed rubber, and the outer edge 131*b* has a greater thickness. In another embodiment, a supporting ring 180 may be disposed between the outer edge 131*b* of the surround 129*a* and the outer edge 126*b* of the damper 124 to raise the surround 129*a* or thin the outer edge 131*b* of the surround 129*a*. The material of the support ring 180 may be metal, and different types of surrounds may be selected as deemed necessary by design.

Figure 5B:
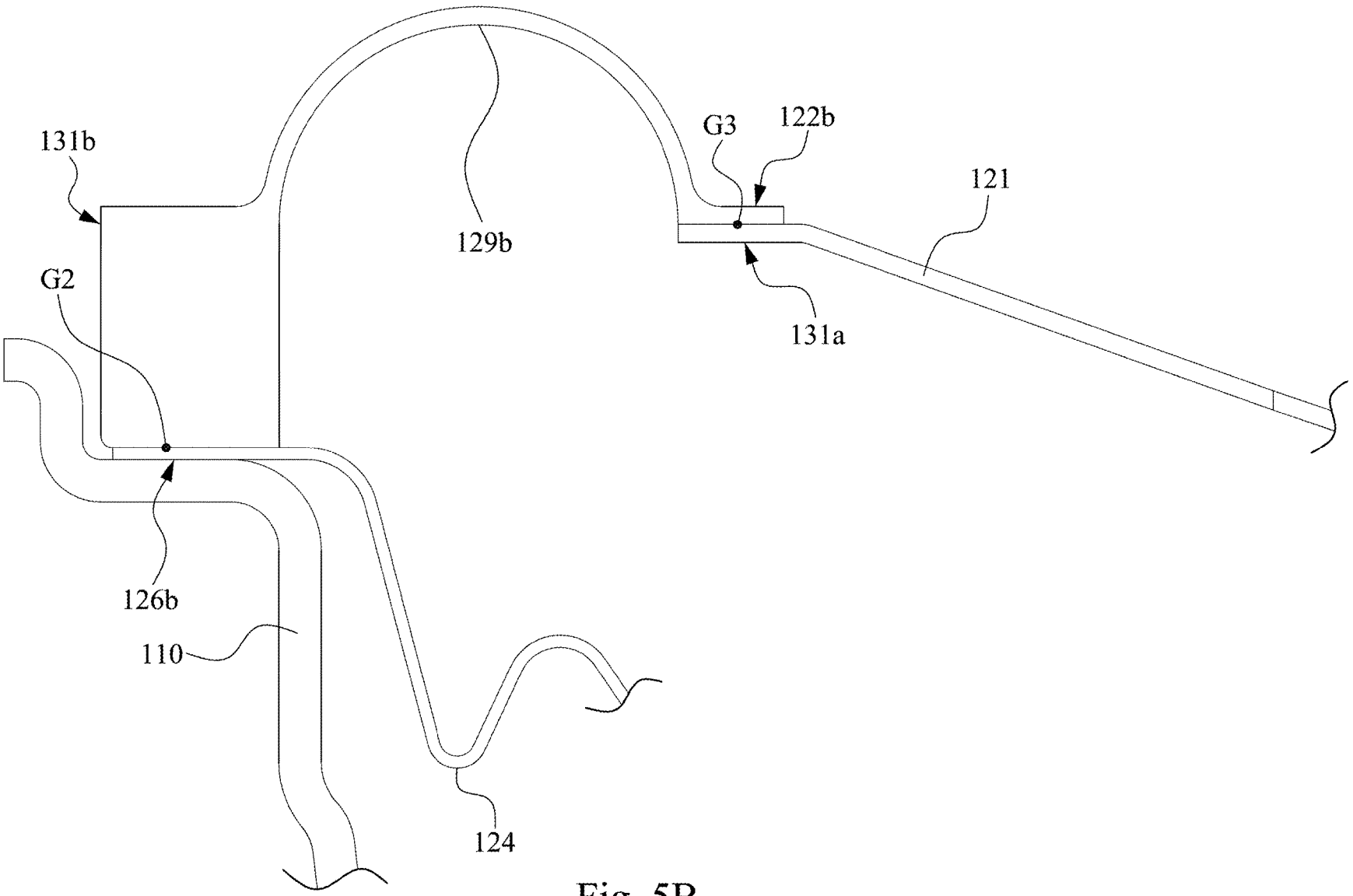
FIG. 5B is a cross-sectional view of a surround according to another embodiment of the present invention.

FIG. 5B is a cross-sectional view of a surround 129*b* according to another embodiment of the present invention. The difference between this embodiment and the embodiment of FIG. 5A is that the cross-sectional shape of the surround 129*b* of FIG. 5B is convex. In this embodiment, the inner edge 131*a* of the surround 129*b* is on the upper side of the outer edge 122*b* of the diaphragm 121, but in other embodiments, the inner edge 131*a* of the surround 129*b* may be on the lower side of the outer edge 122*b* of the diaphragm 121, depending on actual demand.

Figure 5C:
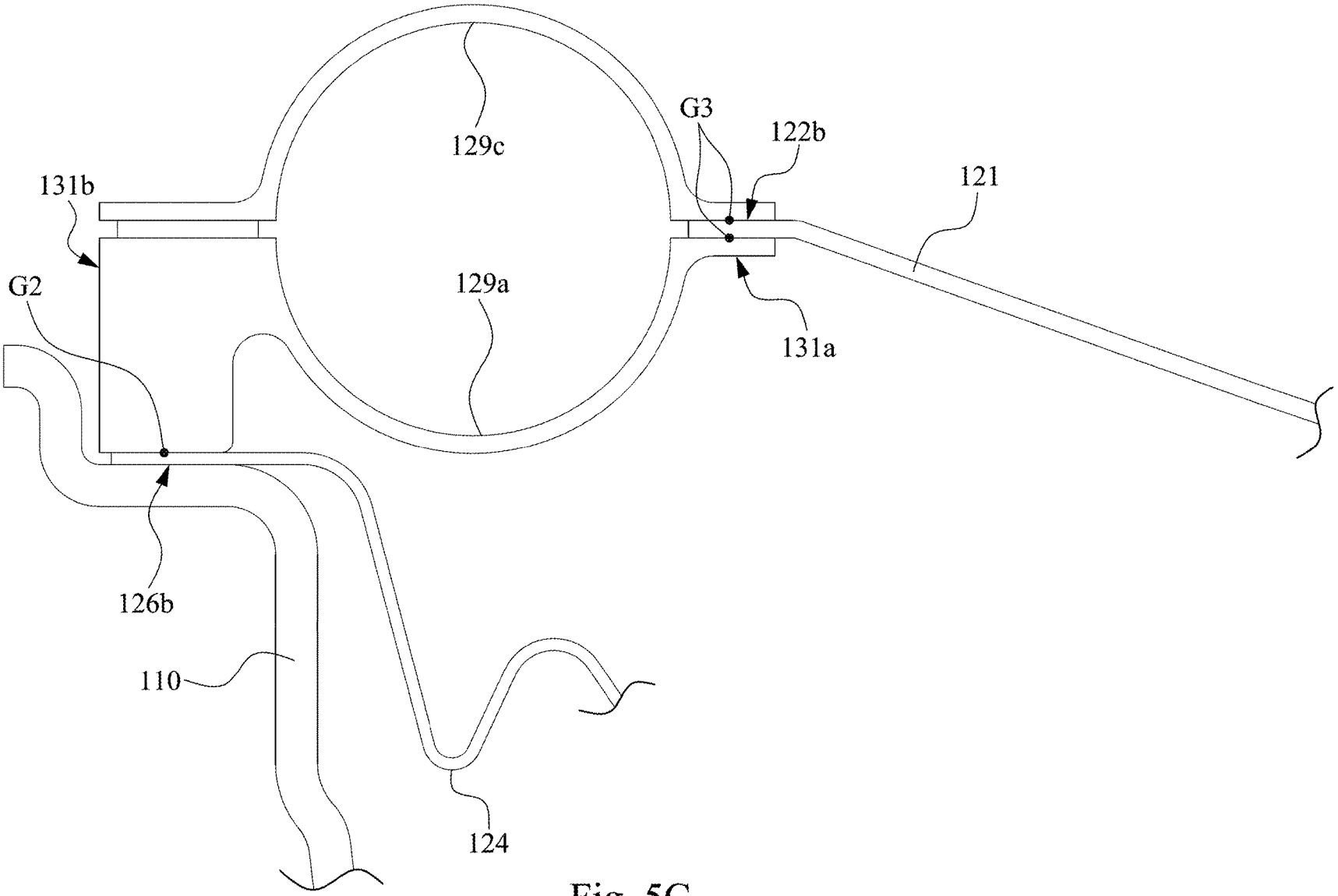
FIG. 5C is a cross-sectional view of a first surround and a second surround according to another embodiment of the present invention.

FIG. 5C is a cross-sectional view of the first surround 129*a* and a second surround 129*c* according to another embodiment of the present invention. The difference between this embodiment and the embodiment of FIG. 5A is that the structure of FIG. 5C has the first surround 129*a* and the second surround 129*c* that is disposed on the first surround 129*a*. In this embodiment, the first surround 129*a* has a concave shape, the second surround 129*c* has a convex shape, and the second surround 129*c* may be adhered to the first surround 129*a* to further form an annular surround assembly. The outer edge 122*b* of the diaphragm 121 is located between the inner edges 131*a* of the first surround 129*a* and the second surround 129*c*.

Figure 5D:
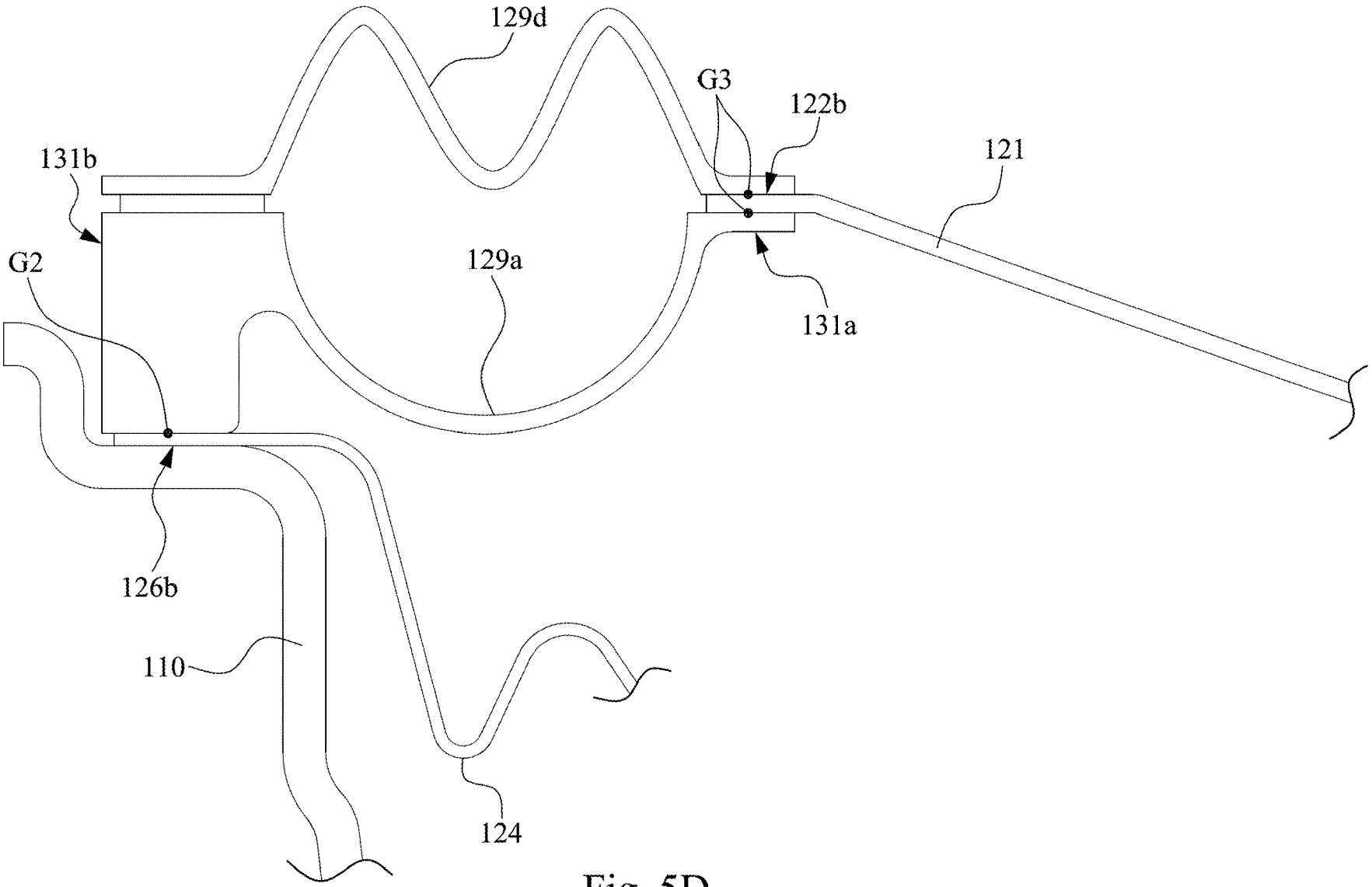
FIG. 5D is a cross-sectional view of a first surround and a second surround according to another embodiment of the present invention.

FIG. 5D is a cross-sectional view of the first surround 129*a* and a second surround 129*d* according to another embodiment of the present invention. The difference between this embodiment and the embodiment of FIG. 5A is that the structure of FIG. 5D has the first surround 129*a* and the second surround 129*d* that is disposed on the first surround 129*a*. In this embodiment, the first surround 129*a* is concave shape, the second surround 129*d* is double triangular or wavy shape, and the second surround 129*d* can be adhered to the first surround 129*a* to further form a surround assembly with a complicated shape. The outer edge 122*b* of the diaphragm 121 is located between the inner edge131*a* of the first surround 129*a* and the second surround 129*d*.

Figure 5E:
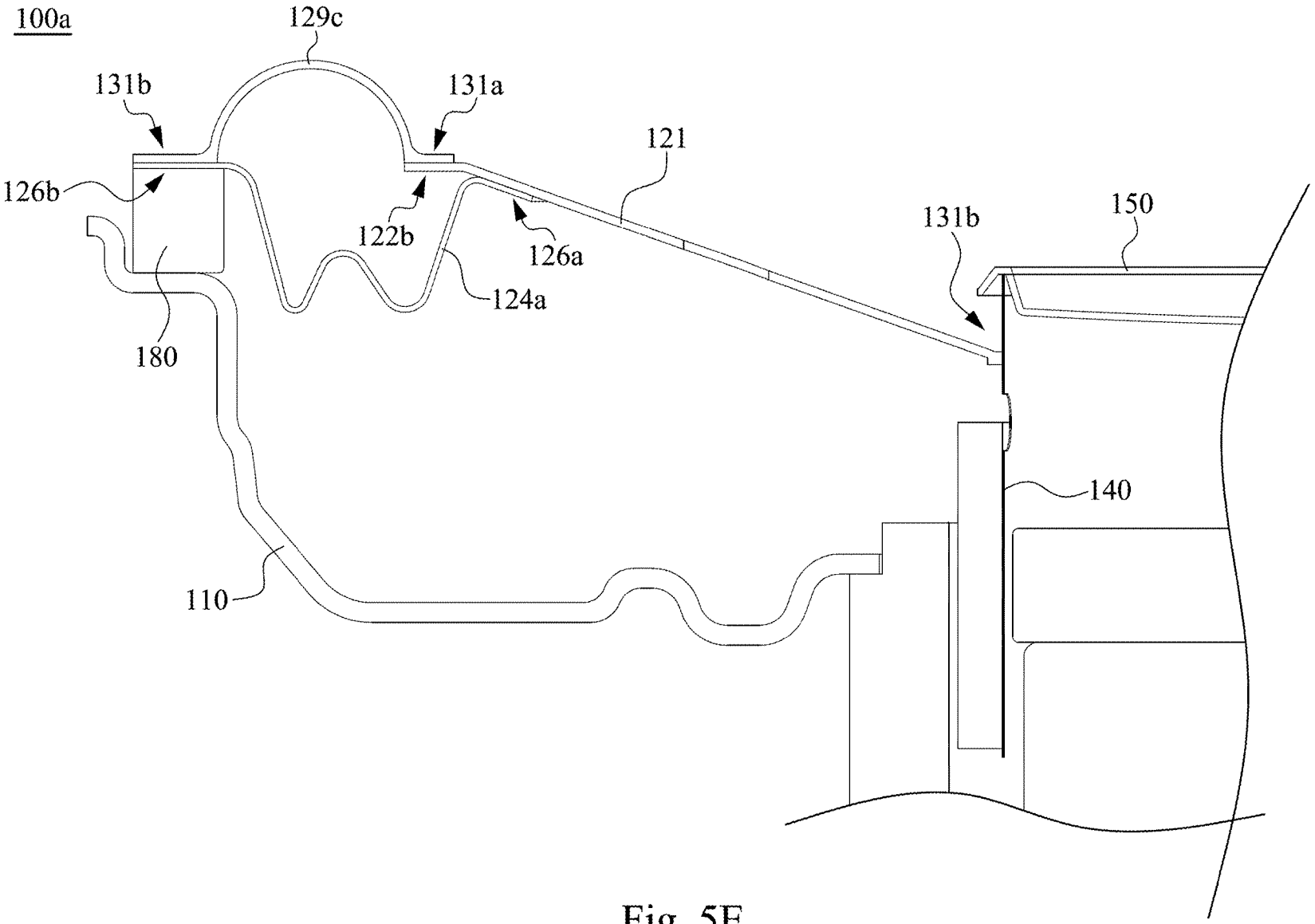
FIG. 5E is a partially cross-sectional view of the speaker according to another embodiment of the present invention.

FIG. 5E is a partially cross-sectional view of a speaker 100*a* according to another embodiment of the present invention. The speaker 100*a* includes the basket 110, the diaphragm 121, a damper 124*a*, and the surround 129*c*. The difference between this embodiment and the embodiment of FIG. 3 is that the cross-sectional shape of the surround 129*c* of FIG. 5E is convex, the inner edge 131*a* of the surround 129*c* is on the upper side of the outer edge 122*b* of the diaphragm 121, and the inner edge 126*a* of the damper 124*a*. is adhered to a position of the bottom surface of the diaphragm 121 adjacent to the outer edge 131*a*. In this embodiment, the speaker 100*a* further includes the support ring 180. The support ring 180 is disposed along the outer edge of the basket 110, and the outer edge 131*b* of the surround 129*c* and the outer edge 126*b* of the damper 124*a* are located on the support ring 180 such that the support ring 180 is located between the outer edge 136*b* of the surround 129*c* and the basket 110. In the embodiment, the material of the support ring 180 may be metal and different from that of the surround 129. In other embodiments, the material of the support ring 180 may be rubber and integrally formed with the surround 129, such as the surround 129*b* of FIG. 5B.

Figure 5F:
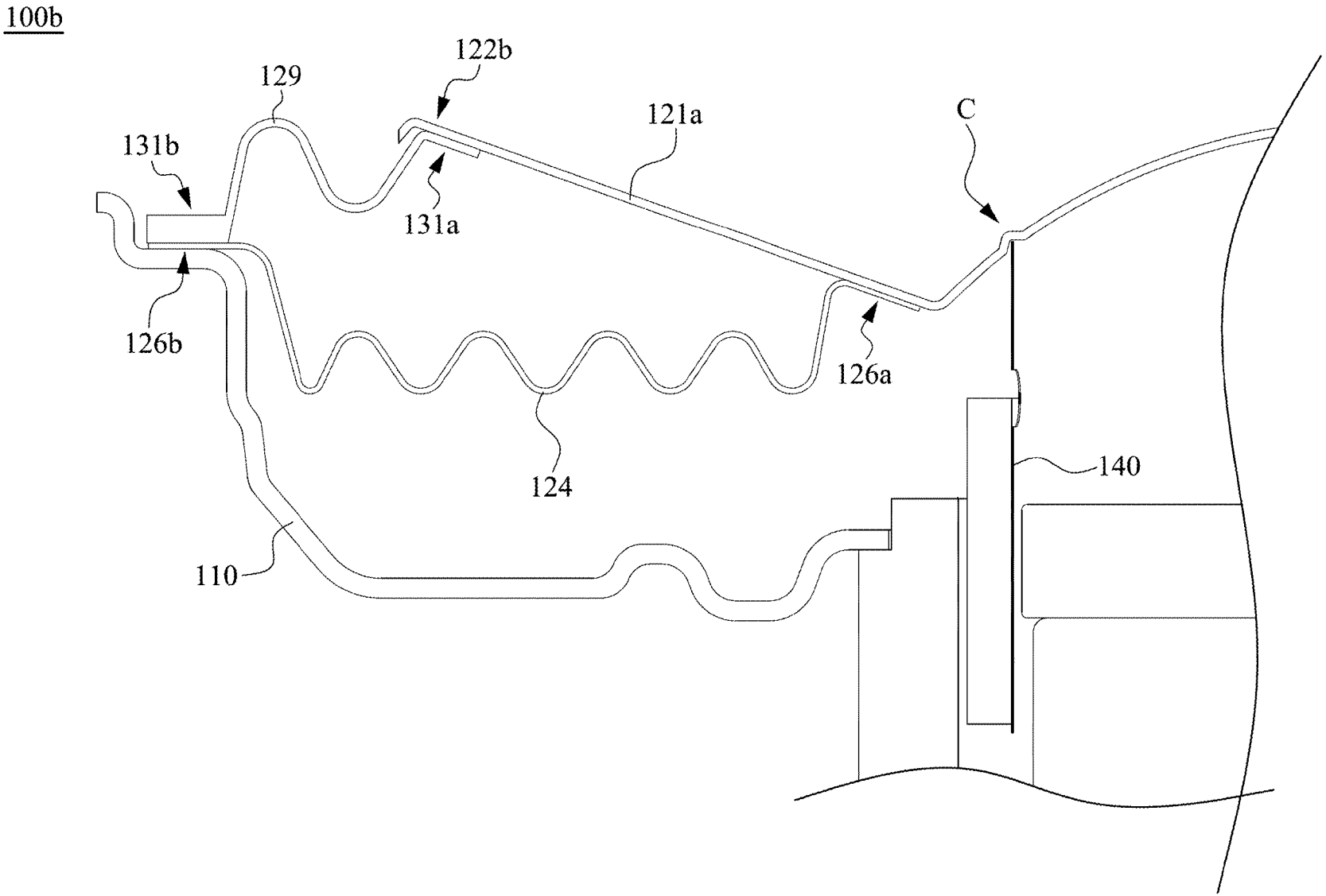
FIG. 5F is a partially cross-sectional view of the speaker according to another embodiment of the present invention.

FIG. 5F is a partially cross-sectional view of a speaker 100*b* according to another embodiment of the present invention. The speaker 100*b* includes the basket 110, a diaphragm 121*a*, the damper 124, the surround 129, and the voice coil 140. The difference between this embodiment and the embodiment of FIG. 3 is that the diaphragm 121*a* of the speaker 100*b* covers the voice coil 140, the central region C of the diaphragm 121*a* is convex, and the dustproof cap 150 of FIG. 3 can be omitted. In this embodiment, the top portion of the voice coil 140 is connected to the bottom surface of the diaphragm 121*a*, and the voice coil 140 is covered by the central region C of the diaphragm 121*a*. In other words, in the present embodiment, the diaphragm 121*a* covers the voice coil 140 and the damper 124 by the surround 129 without additional dustproof cap 150. In addition, the voice coil 140 and the damper 124 can be fixed to the bottom surface of the diaphragm 121*a* by adhesive, and thus assembling is convenient and additional cushions may be omitted.

Figure 5G:
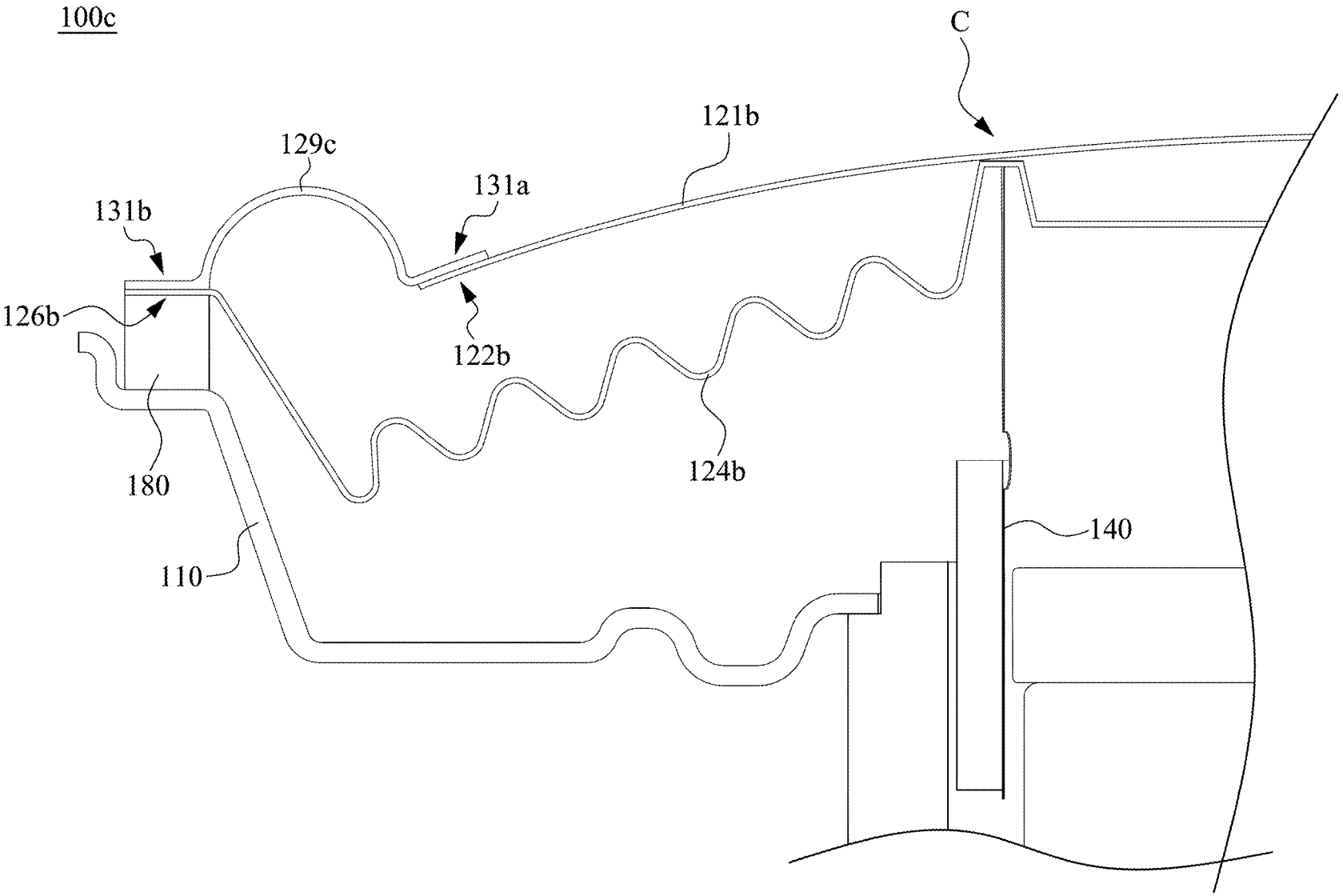
FIG. 5G is a partially cross-sectional view of the speaker according to another embodiment of the present invention.

FIG. 5G is a partially cross-sectional view of a speaker 100*c* according to another embodiment of the present invention. The speaker 100*c* includes the basket 110, a diaphragm 121*b*, a damper 124*b*, the surround 129*c*, the surround ring 180, and the voice coil 140. The difference between this embodiment and the embodiment of FIG. 5E is that the top portion of the voice coil 140 is connected to the bottom surface of the diaphragm 121*b* by the damper 124*b*, and the diaphragm 121*b* and the damper 124*b* are both gradually lowered from the voice coil 140 to the outer edge of the basket 110. That is, the diaphragm 121*b* and the damper 124*b* are in inclined arrangements. Furthermore, the damper 124*b* extends from a position between the support ring 180 and the surround 129*c* to a position between the voice coil 140 and the diaphragm 121*b*.

Figure 5H:
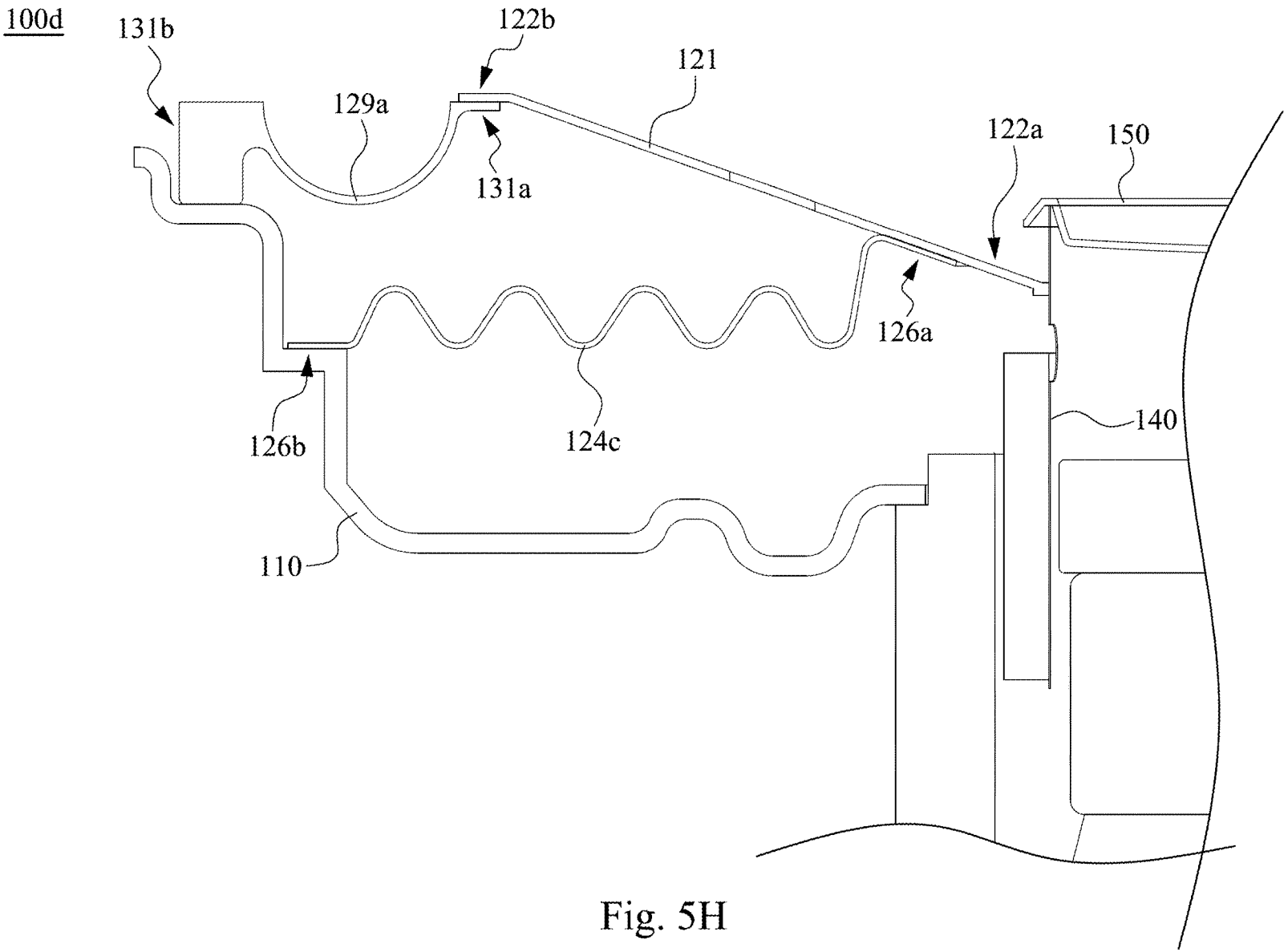
FIG. 5H is a partially cross-sectional view of the speaker according to another embodiment of the present invention.

FIG. 5H is a partially cross-sectional view of a speaker 100*d* according to another embodiment of the present invention. The speaker 100*d* includes the basket 110, the diaphragm 121, a damper 124*c*, the surround 129*a*, and the voice coil 140. The difference between this embodiment and the embodiment of FIG. 5A is that the surround 129*a* and the damper 124*c* are respectively disposed on a first connection position and a second connection position of the basket and at different horizontal levels. As shown in FIG. 5H, the outer edge 131*b* of the surround 129*a* is located on the higher first connection position of the basket 110, and the outer edge 126*b* of the damper 124*c* is located on the lower second connection position of the basket 110, which can provide an alternative choice in design.

Figure 5I:
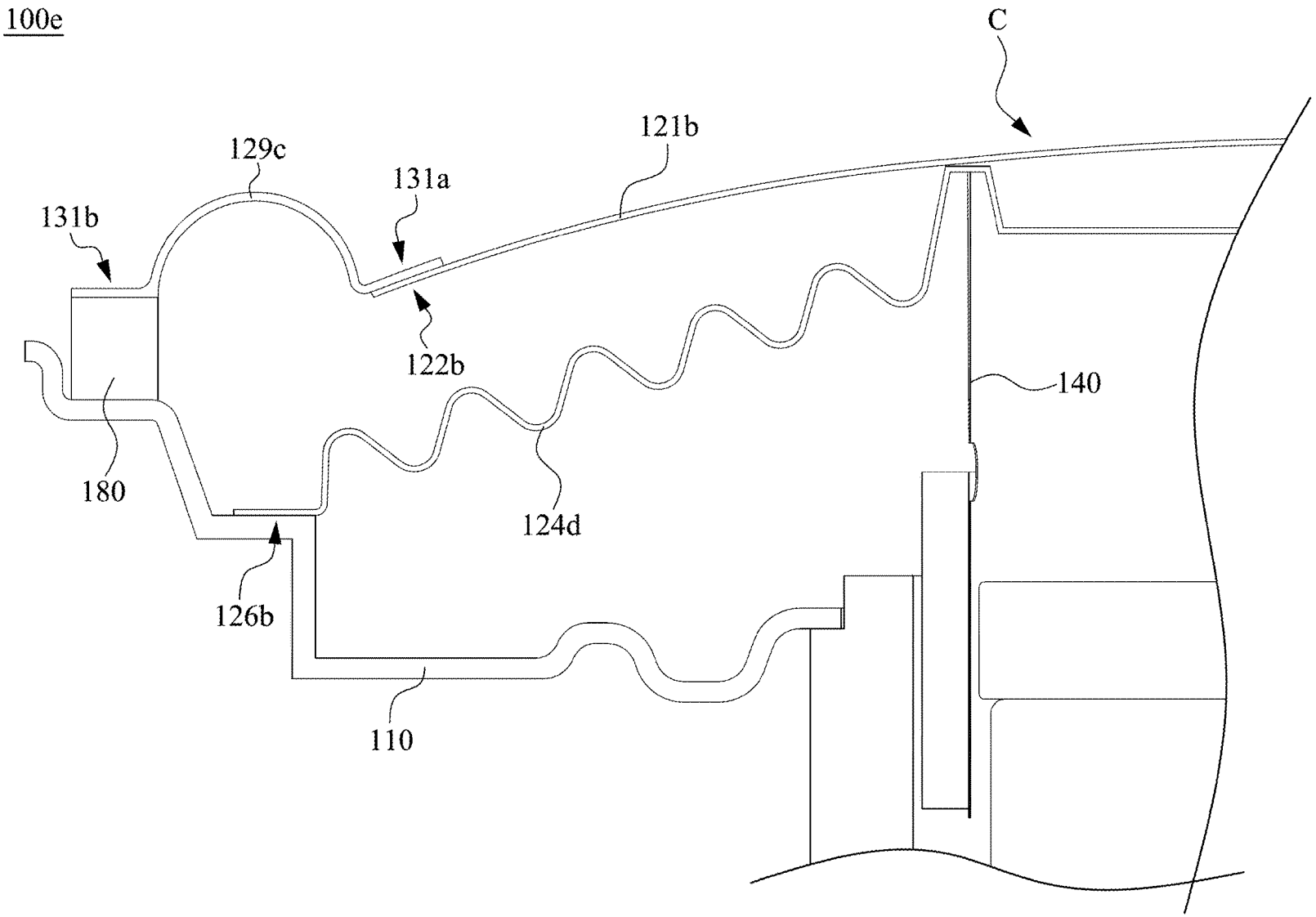
FIG. 5I is a partially cross-sectional view of the speaker according to another embodiment of the present invention.

FIG. 5I is a partially cross-sectional view of a speaker 100*e* according to another embodiment of the present invention. The speaker 100*e* includes the basket 110, the diaphragm 121*b*, a damper 124*d*, the surround 129*c*, and the voice coil 140. The difference between this embodiment and the embodiment of FIG. 5G is that the surround 129*c* and the damper 124*d* are respectively disposed on a first connection position and a second connection position of the basket 110 and at different horizontal levels. As shown in FIG. 5I, the outer edge 131*b* of the surround 129*c* is located on the higher first connection position of the basket 110, and the outer edge 126*b* of the damper 124*d* is located on the lower second connection position of the basket 110, which can provide an alternative choice in design.

It is to be noted that the configurations of the surrounds 129*a*-129*d*, the diaphragms 121*a* and 121*b*, the dampers 124*a*-124*d*, and the support ring 180 of the above-mentioned FIGS. 5A to 5I can be used with the components in the speaker 100 of FIG. 3, depending on actual demand. For example, the conductor 127 of FIG. 3 can be disposed on the bottom surface of the damper 124 of FIG. 5F and the damper 124*b* of FIG. 5G.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims.

What is claimed is:

1. A speaker, comprising:

a basket; and a diaphragm assembly located on the basket, and having a diaphragm, a damper, a surround, and a conductor, wherein an inner edge and an outer edge of the damper are respectively connected to a bottom surface of the diaphragm and the basket, the surround and the damper are disposed on the basket and at different horizontal levels, and the conductor is located on a bottom surface of the damper, and a lengthwise direction of the conductor is the same as a radial direction of the damper, the conductor and the bottom surface of the damper are wave-shaped, and the conductor is conformally on the bottom surface of the damper.

2. The speaker of claim 1, wherein the surround and damper are disposed on a first connection position of the basket and at different horizontal levels.

3. The speaker of claim 1, wherein the surround and damper are respectively disposed on a first connection position and a second connection position of the basket and at different horizontal levels.

4. The speaker of claim 1, further comprising:

a voice coil surrounded by the basket and having a conductive wire, wherein the conductive wire is electrically connected to an end of the conductor proximal to the voice coil, and an end of the conductor facing away from the voice coil passes through the basket.

5. The speaker of claim 1, wherein an inner edge of the surround is connected to an upper side or a lower side of an outer edge of the diaphragm.

6. The speaker of claim 1, further comprising:

a voice coil, wherein a top portion of the voice coil is connected to the bottom surface of the diaphragm, and the voice coil is covered by a central region of the diaphragm.

7. The speaker of claim 6, wherein the top portion of the voice coil is connected to the bottom surface of the diaphragm by the damper.

8. The speaker of claim 6, wherein the diaphragm and the damper are gradually lowered from the voice coil to an outer edge of the basket.

9. The speaker of claim 1, further comprising:

a supporting ring located between an outer edge of the surround and the basket.

* * * * *